US007170008B2

(12) United States Patent
Victor

(10) Patent No.: US 7,170,008 B2
(45) Date of Patent: Jan. 30, 2007

(54) AUDIO SIGNAL CABLE

(76) Inventor: Jay Victor, 2017 Bataan Rd., Unit A, Redondo Beach, CA (US) 90278

( * ) Notice: Subject to any disclaimer, the term of this patent is extended or adjusted under 35 U.S.C. 154(b) by 0 days.

(21) Appl. No.: 11/407,788

(22) Filed: Apr. 20, 2006

(65) Prior Publication Data

US 2006/0185886 A1 Aug. 24, 2006

Related U.S. Application Data

(63) Continuation-in-part of application No. 11/049,062, filed on Feb. 2, 2005, now Pat. No. 7,034,229, which is a continuation-in-part of application No. 10/619,441, filed on Jul. 16, 2003, now Pat. No. 6,969,805.

(51) Int. Cl.
*H01R 7/00* (2006.01)

(52) U.S. Cl. ..... 174/110 R; 174/113 R; 174/115

(58) Field of Classification Search ..... 174/36, 174/110 R, 113 R, 115, 116, 117 F, 117 FF, 174/114 R
See application file for complete search history.

(56) References Cited

U.S. PATENT DOCUMENTS

| | | | | |
|---|---|---|---|---|
| 3,816,644 | A * | 6/1974 | Giffel et al. | 174/115 |
| 4,628,151 | A * | 12/1986 | Cardas | 174/114 R |
| 4,777,324 | A * | 10/1988 | Lee | 174/34 |
| 5,491,299 | A * | 2/1996 | Naylor et al. | 174/36 |
| 5,510,578 | A * | 4/1996 | Dunlavy | 174/128.1 |
| 5,516,986 | A * | 5/1996 | Peterson et al. | 174/113 C |
| 5,976,070 | A * | 11/1999 | Ono et al. | 600/110 |
| 6,194,663 | B1 * | 2/2001 | Friesen et al. | 174/110 R |
| 6,388,188 | B1 * | 5/2002 | Harrison | 174/27 |
| 6,495,763 | B1 * | 12/2002 | Eichmann et al. | 174/113 R |

* cited by examiner

*Primary Examiner*—William H. Mayo, III
(74) *Attorney, Agent, or Firm*—Trojan Law Office

(57) ABSTRACT

An audio signal cable consisting of various combinations of two or more distinct types of conductors. The cable contains at least two conductors of different types. The individual conductors within the cable may be individually insulated or uninsulated. The individual conductors may also be of varying shapes and sizes. The conductors are surrounded by a common insulation. Combining at least two types of different conductors within the cable provides the cable with a versatility to be adaptable to a wide variety of sound applications.

11 Claims, 9 Drawing Sheets

AUDIO SIGNAL CABLE

CLAIM OF PRIORITY

This application is a continuation-in-part and claims the benefit of the priority date of my application Ser. No. 11/049,062, filed Feb. 2, 2005 now U.S. Pat. No. 7,034,229, which is a continuation-in-part of my application Ser. No. 10/619,441, filed Jul. 16, 2003 (now U.S. Pat. No. 6,969, 805), and incorporates the teachings of those two applications as if fully set forth herein.

FIELD OF THE INVENTION

The invention herein relates generally to electric audio cables, and more particularly, to signal carrying cables incorporating a plurality of conductors of varying types and shapes which in combination provide for the improved transmission of audio signals.

BACKGROUND OF THE INVENTION

Signal transmission requirements have become higher because of the greater fidelity and sensitivity of currently available high fidelity audio system equipment. Good signal cables support fine dynamics, separation, and rich overtones, but most importantly, they must have a very high degree of balance. Since balance is the most essential factor of high fidelity acoustics, when full-range balance is poor various problems result.

For example, insufficient bass makes people feel that music is muted and diluted. Conversely, when bass is excessive, sound becomes too dense and even burdensome. Sound becomes cold when midrange is lacking and overly warm when too much is heard. At the same time, overall definition is decreased resulting in acoustic dispersion, sound alteration, and positional inaccuracy problems. Also, when treble projection is inadequate, music becomes depressive, monotonous, and spatially confined, while the reverse situation results in a presentation that is too bright and lively.

It is widely known that electric wires and cables utilize conductors for the transmission of signals. Typically, the cross-sectional area of conductors used in a wire or cable is chosen in view of the expected magnitude of transmission current. In a conventional audio signal cable, the cross-sectional area is based on three main considerations. The first is the amount of transmission current, the second is the tensile strength needed, and the third is the outer diameter required. After the conductor cross-sectional areas are calculated, other factors are considered to select the differing diameters of the conductors.

In conventionally used electric cables, the center conductor is typically a single conductor, and if the conductor is too narrow, electrical resistance increases. However, if the conductor is too large, then high frequency signal passage becomes difficult. Additionally, in conventional signal cables, skin effect is a challenging problem in that it commonly causes distortion and adversely affects signal transmission. A major problem with the presently known cables is that these cables utilize conductors which are not designed to effectively carry more than one type of signal frequency. For example, when such cables are used to simultaneously transmit at different bands of frequency (i.e., high, medium, and low frequencies), the problem of phase difference occurs.

There are currently known electric cables where the center conductor is in the form of multiple conductors. For example, stranded wire is a configuration of two or more circular round solid conductors, usually fairly small, of the same wire gauge, and uninsulated from each other, but commonly insulated by one piece of insulation. Stranded wire is more flexible than a single, thick strand of the same gauge. Stranded wire is commonly used for electrical applications carrying audio data signals.

While stranded wire is generally undesirable for high fidelity (Hi-Fi) sound reproduction, where maximum clarity, and lowest possible distortion is the goal, for guitar this is not quite the case. It is well known that most electric guitar players prefer a certain amount of distortion, and the distortion realized by using stranded wire does seem to have a pleasing sonic effect on electric instruments. In this case, absolute fidelity is not required, as demonstrated by the fact that most amplifiers are intentionally driven into distortion for the sonic effect. This is seen as being pleasing, desirable and beneficial. However, there are no presently known audio cables that provide the distortion effect and that are capable of simultaneously providing additional sound enhancements which are desirable for electric instruments.

Accordingly, there is a need for a for an audio signal cable that overcomes the problems of the prior art and which is capable of providing a balanced high, medium and low frequency response, as well as better sound definition.

SUMMARY OF THE INVENTION

The present invention satisfies the above-referenced need. An objective of the invention herein is to provide an audio signal cable capable of solving the technological problems associated with simultaneous transmission of signals at different bands of frequency by preventing phase difference occurrences. Another objective of the present invention is to provide a cable which provides the optimal sound suited for electric musical instruments.

To achieve these objectives, the invention is an audio signal cable comprising at least two types of different conductors. The conductors are parallel arrayed and are insulated by a common insulation. The combination of two or more different conductors in one cable has the ability to provide an improved sound both in high fidelity and electric instrument applications.

In one embodiment of the present invention, the audio cable comprises at least one circular solid conductor and at least one flat solid conductor. In another embodiment, the audio cable comprises at least one circular solid conductor and at least one tinsel conductor. In yet another embodiment, the audio cable of the invention comprises at least one circular solid conductor and at least one magnet wire conductor.

In a further embodiment of the present invention, the audio cable comprises at least one stranded wire conductor and at least one tinsel wire conductor. In another embodiment, the present invention is an audio cable comprising at least one stranded wire conductor and at least one circular solid conductor. In yet another embodiment, the invention is an audio cable comprising at least one stranded wire conductor and at least one flat solid conductor.

In still another embodiment, the audio cable comprises at least one stranded wire conductor, at least one circular solid conductor, and at least one tinsel wire conductor. In another embodiment, the audio cable of the present invention comprises at least one stranded wire, at least one flat solid conductor and at least one tinsel wire.

In yet another embodiment, the audio cable of the present invention comprises at least one stranded wire, at least one flat solid conductor and at least one circular solid conductor. In still another embodiment, the audio cable comprises at least one stranded wire, at least one flat solid conductor, at least one circular solid conductor and at least one tinsel wire.

The conductors of the described embodiments may have different cross-sectional areas and different geometric shapes. The conductors may also be twisted together. The individual conductors may be insulated or uninsulated. A common insulation surrounds all of the conductors.

The various combinations of at least two different conductors within the cable of the present invention provide users with great flexibility in choosing the desired distortion effect produced by an electric instrument while maintaining high signal quality as well as avoiding skin effect and phase difference problems.

BRIEF DESCRIPTION OF THE DRAWINGS

These features, aspects and advantages of the present invention will become better understood with regard to the following description, appended claims and accompanying figures where:

DETAILED DESCRIPTION OF THE INVENTION

The following discussion describes in detail several embodiments of the invention and several variations of those embodiments. This discussion should not be construed, however, as limiting the invention to those particular embodiments. Practitioners skilled in the art will recognize numerous other embodiments as well.

Figure 1A:
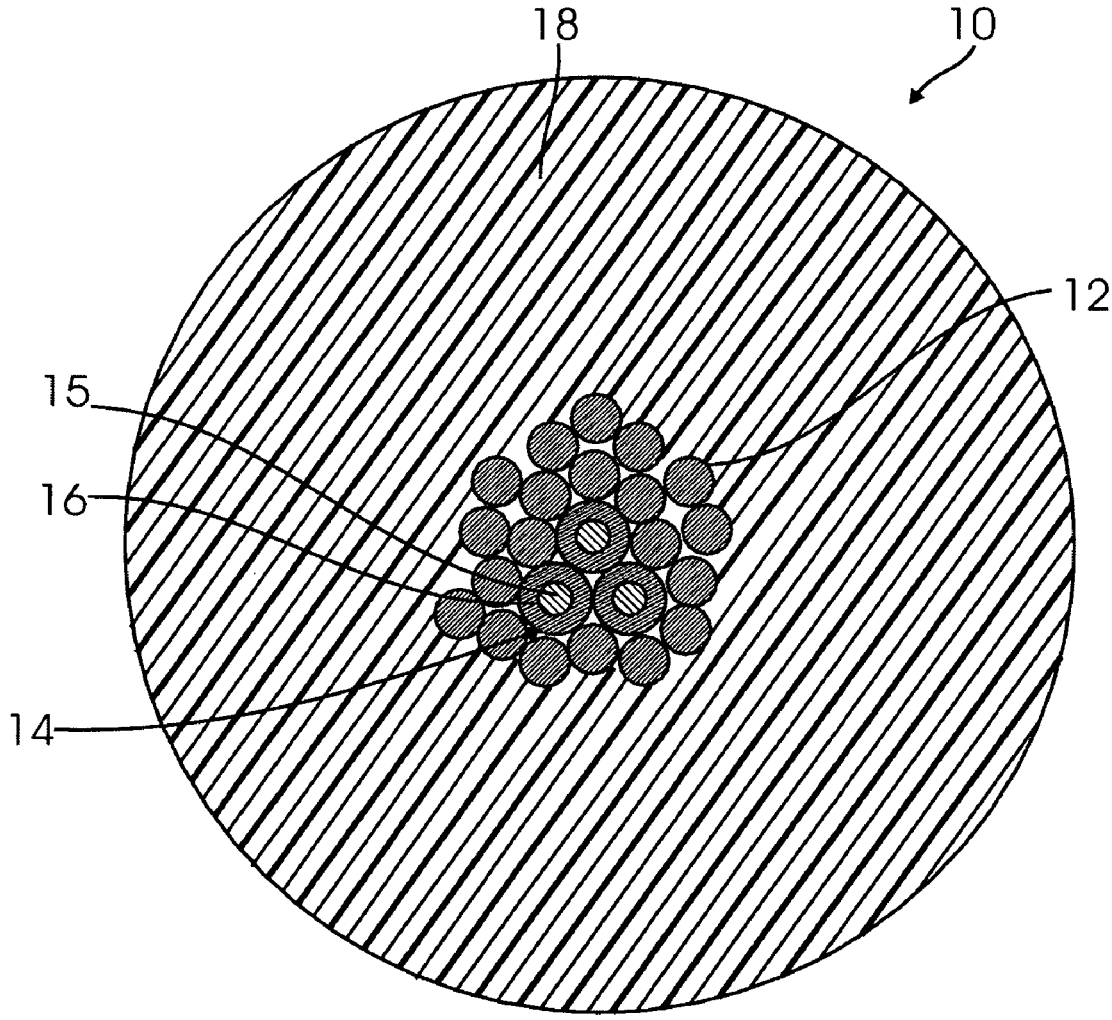
FIG. 1A is a cross-sectional view of an embodiment of the invention which comprises stranded wire conductors and tinsel wire conductors.

Referring to FIG. 1A, the cross-sectional drawing of one preferred embodiment of the audio cable 10 of the invention, stranded wire 12 comprises one conductor and tinsel wire 14 comprises another conductor. Although three tinsel wires are shown in the drawing, the number of tinsel wires may be varied in accordance with signal frequency ranges and harmonic distortion requirements. Tinsel wire 14 is shown as a polyethylene strand 15 covered by copper foil 16. The conductors within the audio cable 10 are surrounded by a common insulation 18.

Stranded wire refers to any two or more conductor wires which are individually uninsulated but which share common insulation. Tinsel wire is one where copper foil is interlaced around numerous nylon or cotton fibers to form a very narrow conductor. In the preferred embodiment of the present invention, copper foil is interlaced around polyethylene fibers. Since tinsel wire has a fibrous center, it has increased tensile strength and bending resistance when compared to conventional conductors. The tinsel interlacing approach of the invention provides greater distance between conductors, enabling a larger surface area that lowers skin effect and benefits high frequency transmission.

In this embodiment of the invention, the stranded wire accounts for adding distortion to the sound, which seems to have a pleasing sonic effect on electric instruments, such as electric guitar. The tinsel wire adds clarity to the sound and provides the capability of carrying more extended high frequencies. It was found by the inventor that the combination of stranded wire and tinsel wire together performed significantly better than stranded wire alone.

Figure 1B:
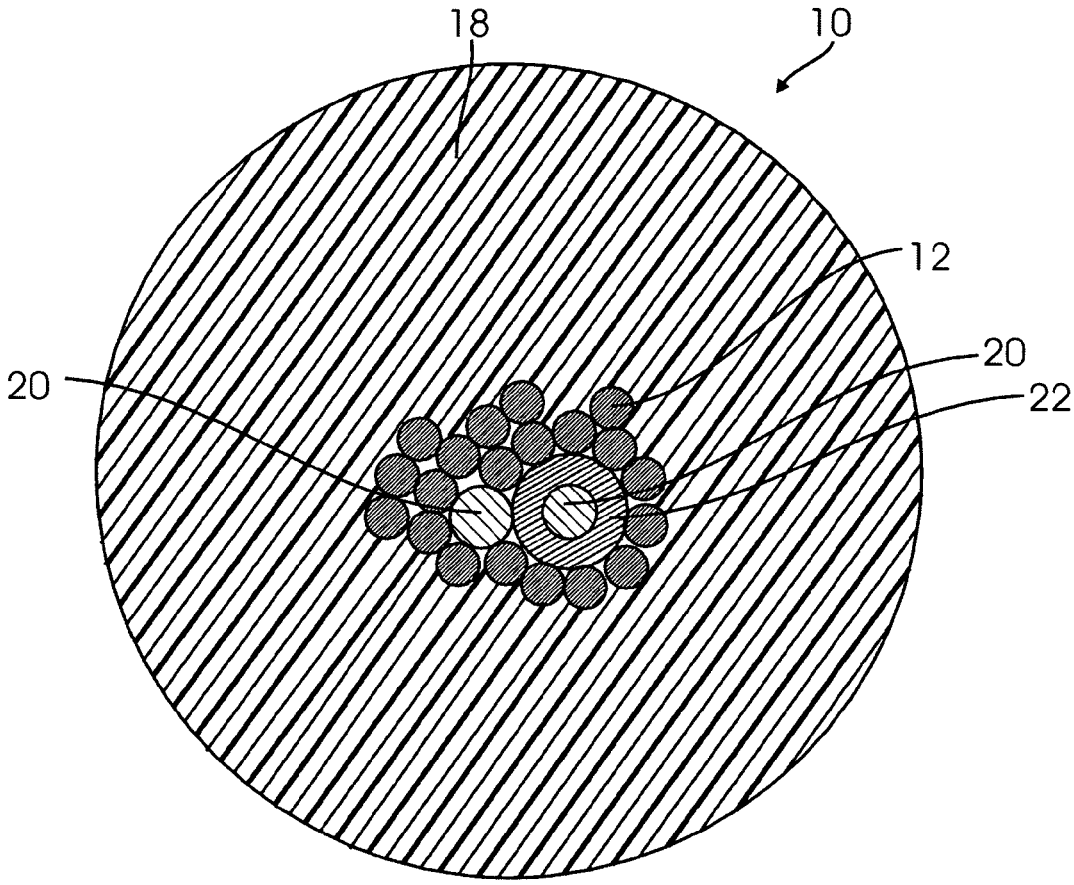
FIG. 1B is a cross-sectional view of an embodiment of the invention which comprises stranded wire conductors and circular solid conductors.

Referring to FIG. 1B, illustrating a cross-sectional drawing of an alternative embodiment of the audio cable 10 of the invention, stranded wire 12 comprises one conductor. Instead of tinsel wire as seen in the embodiment shown in FIG. 1A, solid circular wire 20 comprises another conductor. As shown in FIG. 1B, the audio cable 10 comprises one solid circular wire 20 which is uninsulated and one solid circular wire 20 insulated by its own insulation 22. Although this combination was found by the inventor to be preferred, the number of insulated and uninsulated solid circular conductors can be varied as necessary to accommodate individual signal frequency ranges and harmonic distortion requirements. That is, a cable according to this embodiment may have all insulated, all uninsulated, or a combination of insulated and uninsulated circular solid conductors. Still referring to FIG. 1B, common insulation 18 surrounds the conductors within the audio cable.

In this embodiment of the invention, the stranded wire again accounts for adding distortion to the sound. The addition of circular solid conductors to stranded wire conductors was found to provide the cable with an improved ability to carry bass sounds as compared to a cable having stranded wire alone. That is, the combination of the stranded wire and the circular solid conductor resulted in pleasing harmonic distortion with enhanced bass, an effect that is very desirable for most electric guitar players.

Figure 1C:
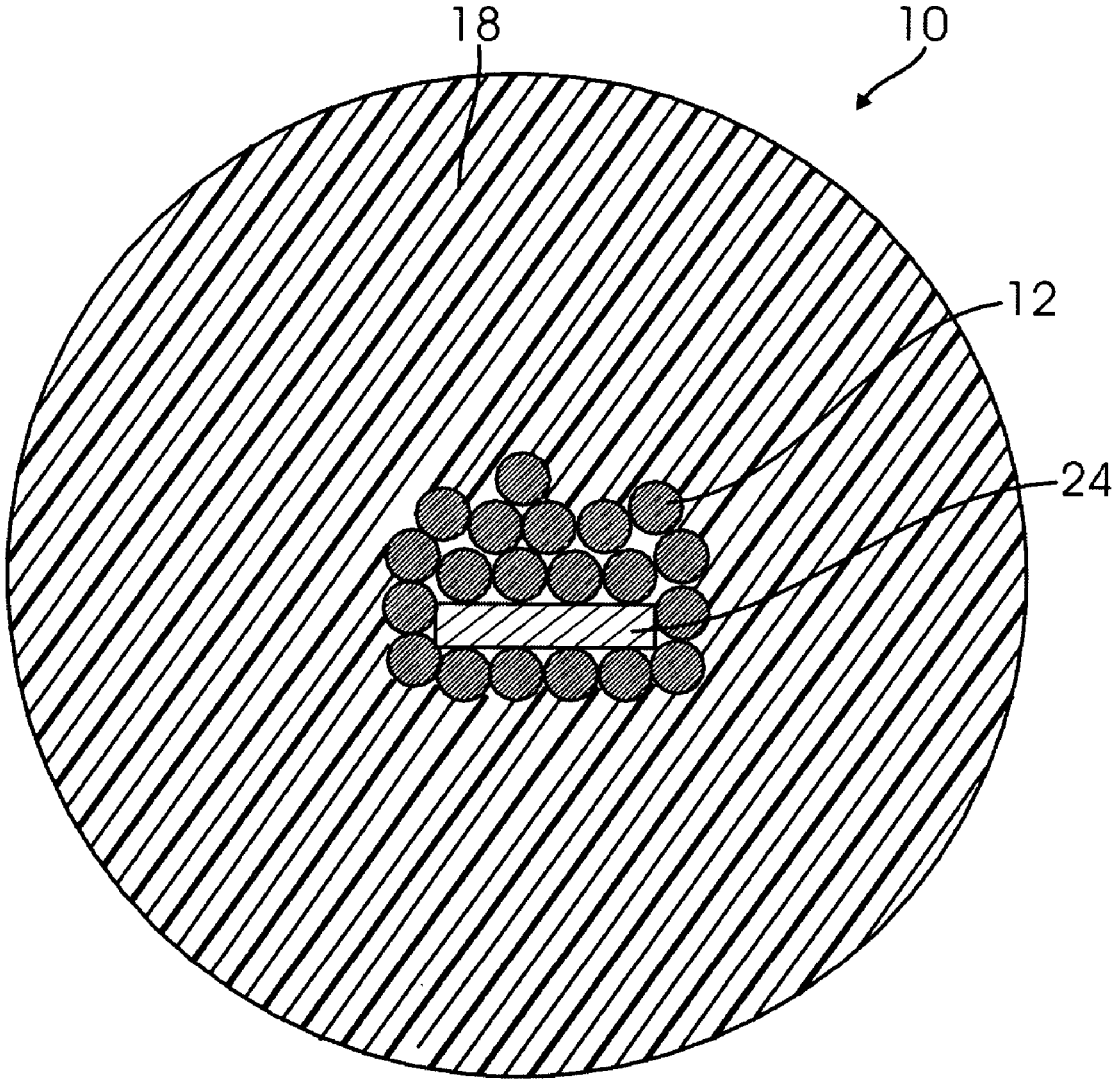
FIG. 1C is a cross-sectional view of an embodiment of the invention which comprises stranded wire conductors and flat solid conductors.

Referring to FIG. 1C, illustrating a cross-sectional drawing of another alternative embodiment of the audio cable 10 of the invention, stranded wire 12 comprises one conductor. Instead of a tinsel wire conductor as seen in the embodiment shown in FIG. 1A, and instead of a circular solid conductor as seen in the embodiment shown in FIG. 1B, a flat solid wire 24 comprises another conductor in this embodiment. As with the other embodiments, although FIG. 1C illustrates only one solid flat conductor within the cable, the actual number of conductors used may be varied in accordance with signal frequency ranges and harmonic distortion requirements. Common insulation 18 surrounds the conductors within the audio cable 10.

In this embodiment of the invention, the stranded wire also accounts for adding distortion to the sound. The combination of flat solid conductors and stranded wire conductors was found to provide the cable with an improved ability to carry midrange sounds as compared to a cable having stranded wire alone. That is, the combination of the stranded wire and the flat conductor resulted in pleasing harmonic distortion with midrange clarity, an effect which is very desirable for most electric guitar players.

Figure 1D:
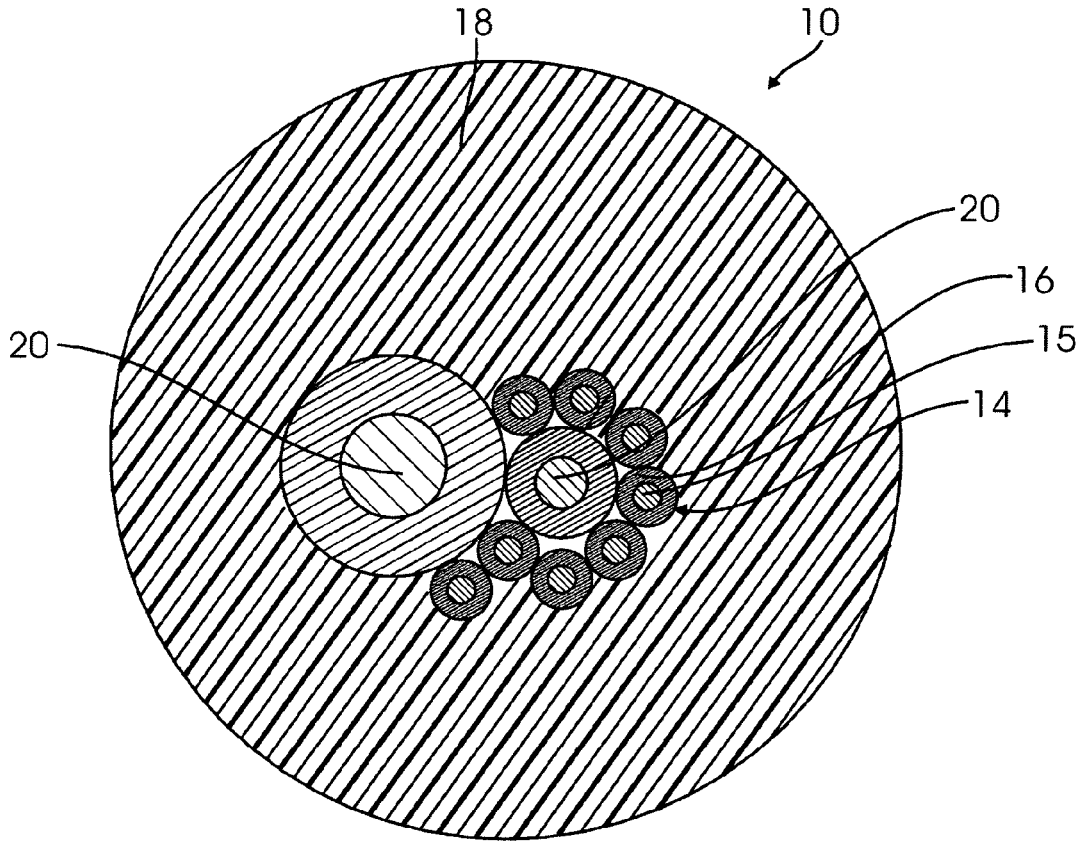
FIG. 1D is a cross-sectional view of an embodiment of the invention which comprises circular solid conductors and tinsel conductors.

Referring to FIG. 1D, the cross-sectional drawing of another alternative embodiment of the audio cable 10 of the invention, circular solid wire 20 comprises one conductor and tinsel wire 14 comprises another conductor. Although two circular solid wires 20 and eight tinsel wires 14 are shown in the drawing, the number of actual wires used may be varied in accordance with signal requirements. In addition, although the circular solid conductors 20 are illustrated as being insulated by insulation 22, these conductors could be uninsulated as well. The conductors within the audio cable 10 are surrounded by a common insulation 18.

In this embodiment of the invention, the circular solid conductors could be used in different gauges to account for varying sound effects. For example, using large gauge circular solid conductors would add bass to the sound, while using medium gauge circular solid conductors would add midrange clarity. As in the other embodiments, the tinsel conductors account for the high frequency capabilities of the cable.

Figure 1E:
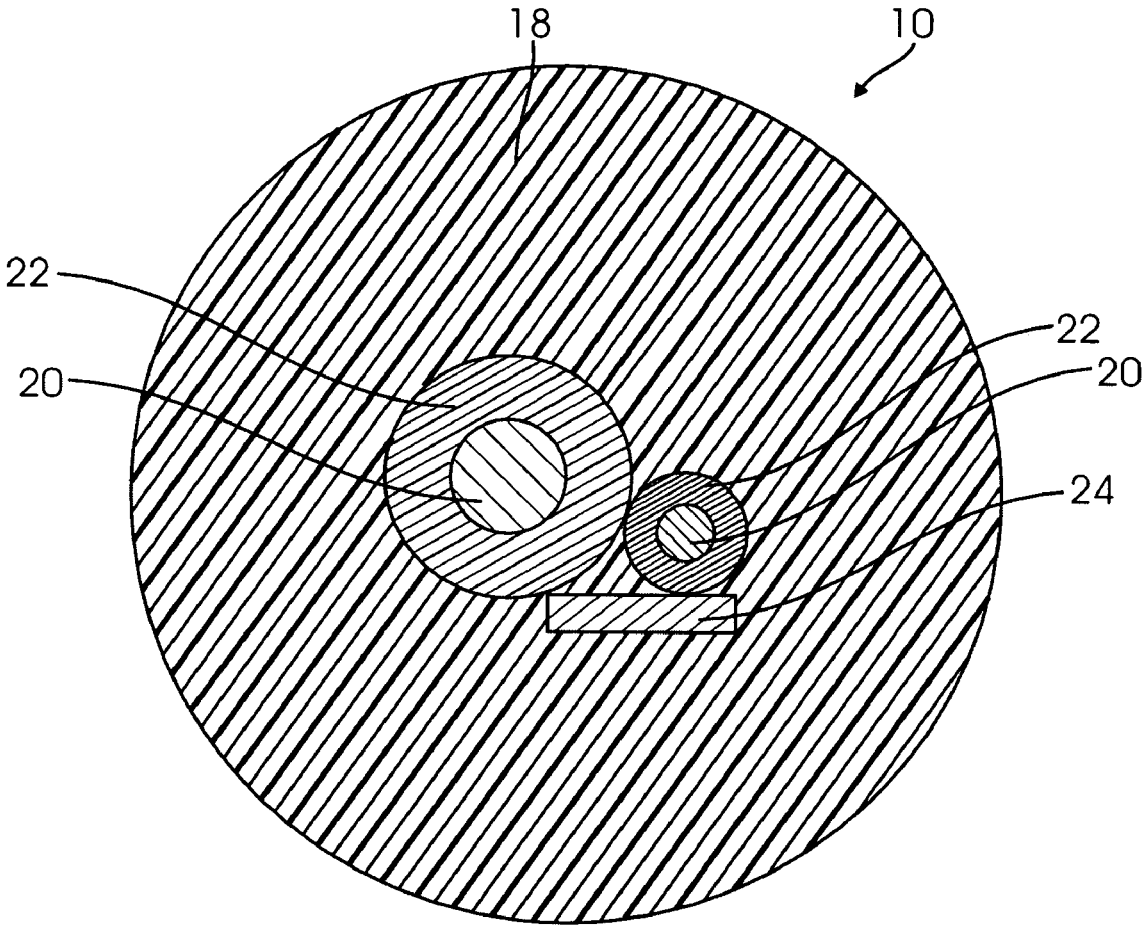
FIG. 1E is a cross-sectional view of an embodiment of the invention which comprises circular solid conductors and flat solid conductors.

Referring to FIG. 1E, the cross-sectional drawing of another alternative embodiment of the audio cable 10 of the invention, circular solid wire 20 comprises one conductor and flat solid wire 24 comprises another conductor. Although only two circular solid wires 20 and one flat solid wire 24 are shown in the drawing, the number of actual wires used may be varied in accordance with signal requirements. In addition, although the circular solid conductors 20 are illustrated as being insulated by insulation 22, this conductor could be uninsulated as well. The conductors within the audio cable 10 are surrounded by a common insulation 18.

Just like in the embodiment illustrated in FIG. 1D, the circular solid conductors could be used in different gauges to account for varying frequency ranges. In this embodiment, in addition to the bass and high frequency capabilities provided by a large gauge or small gauge circular solid conductor, the flat solid conductor provides for improved capabilities of the cable.

Figure 1F:
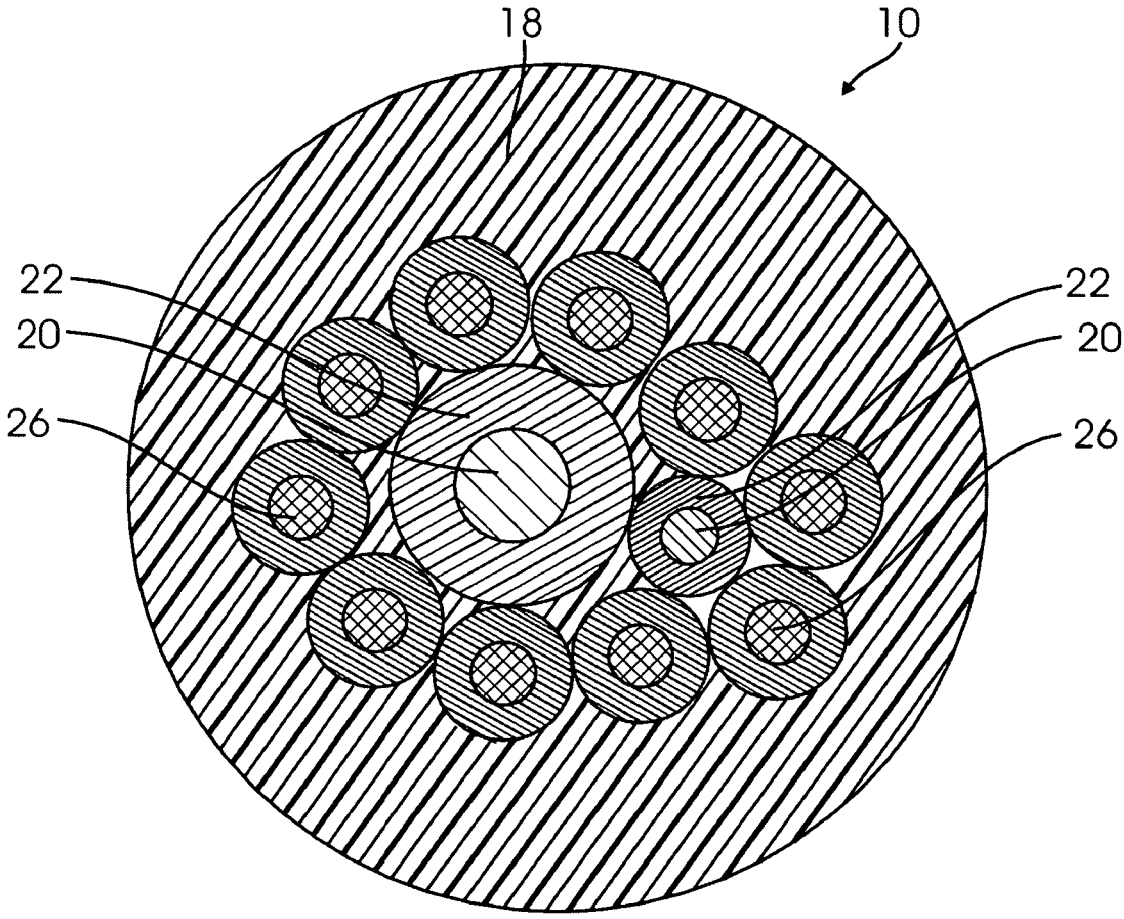
FIG. 1F is a cross-sectional view of an embodiment of the invention which comprises circular solid conductors and magnet wire conductors.

Referring to FIG. 1F, the cross-sectional drawing of another alternative embodiment of the audio cable 10 of the invention, circular solid wire 20 comprises one conductor and magnet wire 26 comprises another conductor. Although only two circular solid wires 20 and ten magnet wires 26 are shown in the drawing, the number of actual wires used may be varied in accordance with signal requirements. In addition, although the circular solid conductor 20 is illustrated as being insulated by insulation 22, this conductor could be uninsulated as well. The conductors within the audio cable 10 are surrounded by a common insulation 18.

Just like in the embodiments illustrated in FIGS. 1D and 1E, the circular solid conductors of this embodiment could be used in different gauges to account for varying frequency ranges. In this embodiment, in addition to bass and midrange effects provided by a large gauge or a small gauge circular solid conductor, the magnet wire conductor provides for the high frequency capabilities of the cable.

According to the present invention, the conductors used in various embodiments of the signal cable can be of varying gauges. Further, the conductors utilized can be of varying geometric shapes. The quantity and types of conductors in the cable of the invention can be chosen according to signal that the cable is expected to carry. The primary principle of the present invention which remains unchanged in all of the embodiments is that one signal-carrying cable comprises at least two types of different conductors. Although not all possible combinations of conductors within the cable of the invention are specifically described/illustrated in this specification, one of ordinary skill in the relevant art will recognize that any audio signal cable not described here but employing two or more types of different conductors is within the scope of this invention. Some representative embodiments of the present invention where the cable contains more than two types of different conductors are presented below.

Figure 2:
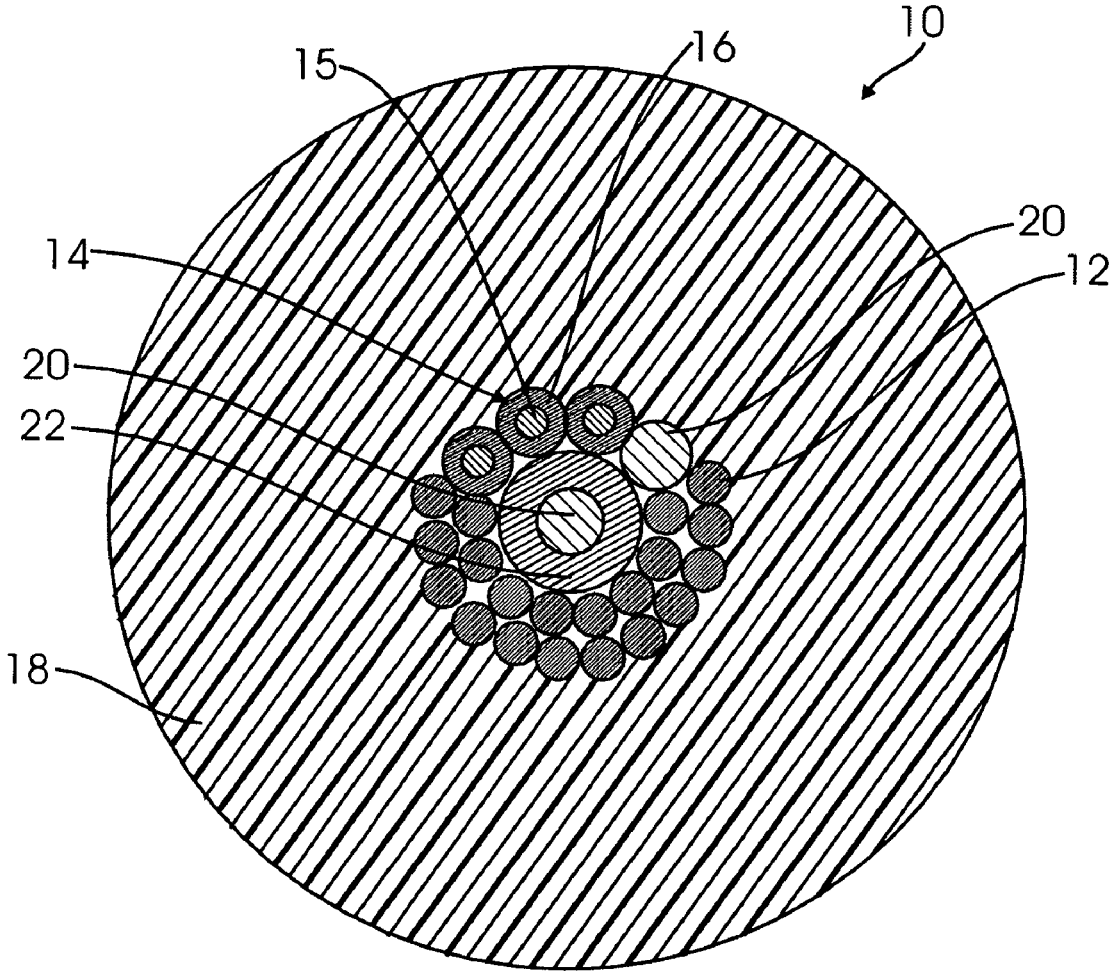
FIG. 2 is a cross-sectional view of an embodiment of the invention which comprises stranded wire conductors, tinsel wire conductors and circular solid conductors.

Referring to FIG. 2, illustrating a cross-sectional drawing of another embodiment of the invention, in the audio cable 10, stranded wire 12 comprises one conductor. Circular solid wire 20 comprises another conductor. Tinsel wire 14 comprises another conductor. Common insulation 18 surrounds the conductors within the audio cable 10. Similarly to the embodiment shown in FIG. 1B, the audio cable 10 shown FIG. 2 also comprises one uninsulated circular solid conductor 20 and one circular solid conductor 20 insulated by its own insulation 22. The cable of this embodiment combines the distortion effect of stranded wire, the high-fidelity capabilities of tinsel wire and the bass-carrying capabilities of circular solid wire.

Figure 3:
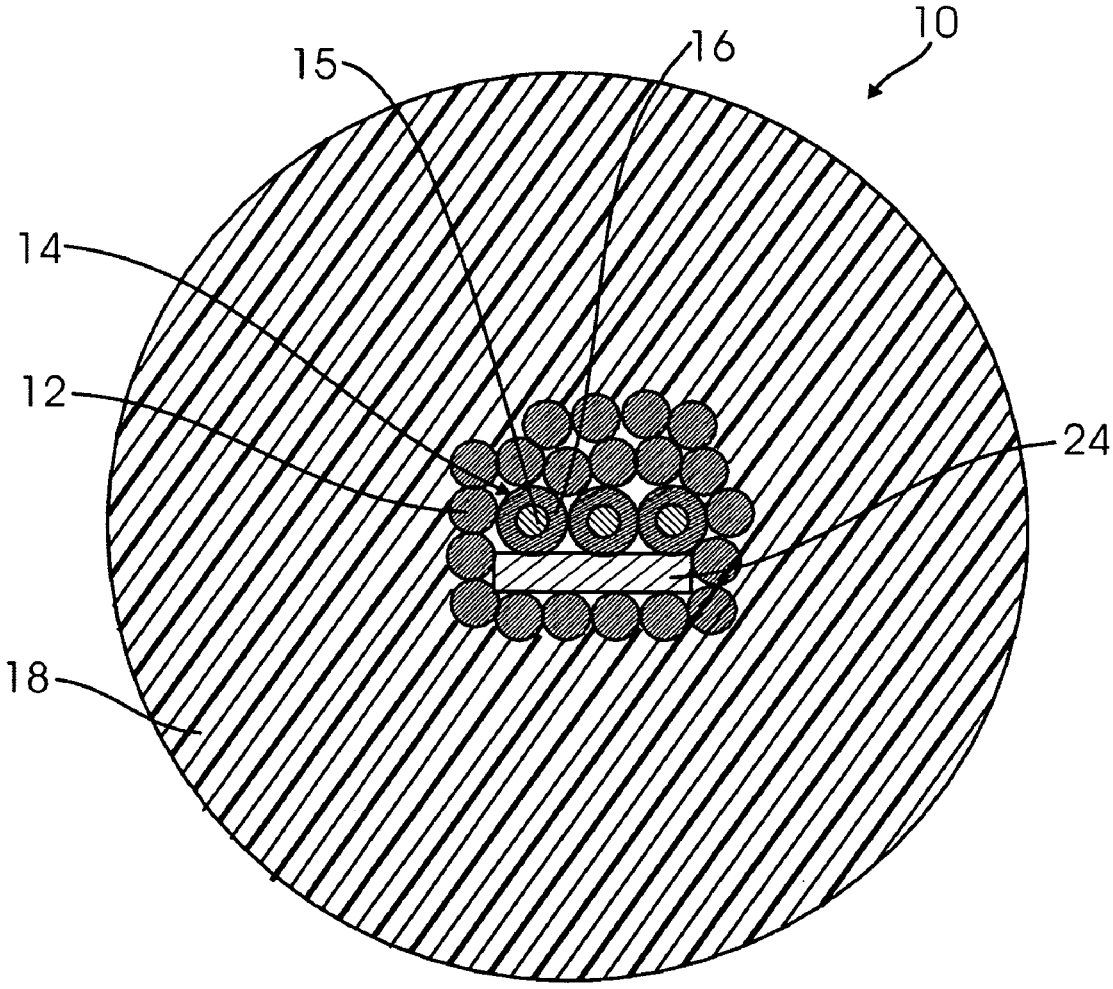
FIG. 3 is a cross-sectional view of an embodiment of the invention which comprises stranded wire conductors, tinsel wire conductors and flat solid conductors

Referring to FIG. 3, illustrating a cross-sectional drawing of another embodiment of the invention, in the audio cable 10, stranded wire 12 comprises one conductor. Tinsel wire 14 comprises another conductor. In addition, flat solid wire 24 comprises another conductor. Common insulation 18 surrounds the conductors within the audio cable 10. The cable of this embodiment combines the distortion effect of stranded wire, the high-fidelity capabilities of tinsel wire and the midrange clarity effect of flat solid wire.

Figure 4:
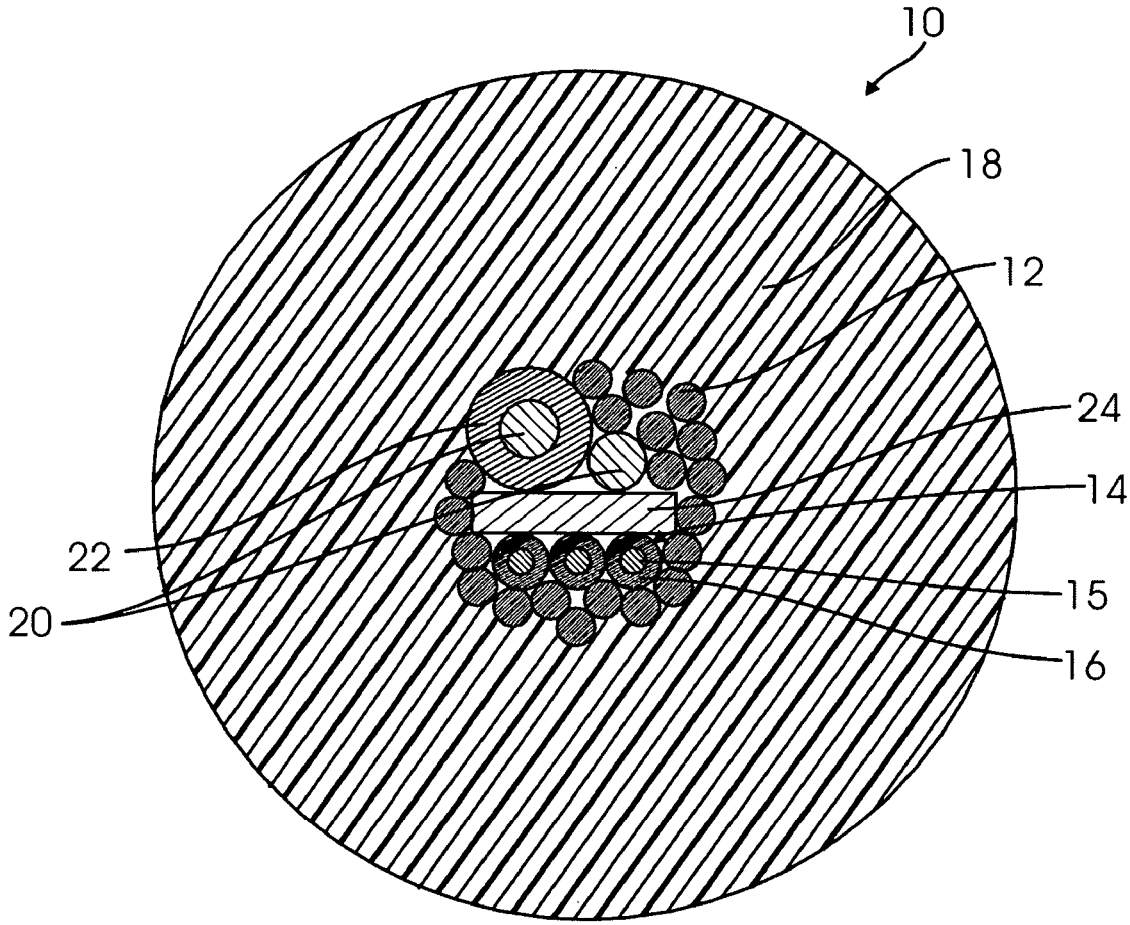
FIG. 4 is a cross-sectional view of an embodiment of the invention which comprises stranded wire conductors, tinsel wire conductors, flat solid conductors and circular solid conductors.

Referring to FIG. 4, illustrating a cross-sectional drawing of another embodiment of the invention, in the audio cable 10, stranded wire 12 comprises one conductor. Circular solid wire 20, tinsel wire 14 and flat solid wire 24 comprise the other conductors. Common insulation 18 surrounds the conductors within the audio cable 10. Similarly to the embodiments shown in FIG. 1B and FIG. 2, the audio cable 10 shown FIG. 4 also comprises one circular solid conductor 20 which is uninsulated and one circular solid conductor 20 which is insulated by its own insulation 22. The cable of this embodiment combines the distortion effect of stranded wire, the high-fidelity capabilities of tinsel wire, the midrange clarity effect of flat solid wire, and the bass enhancement provided by circular solid wire.

The word conductor refers to any material capable of electrical conductance; various metals are most often utilized and thus any suitable metallic material can be employed for fabrication, including solid copper or multi-stranded copper wire; silver-, aluminum-, steel- or other metal-based metallic coatings; and metal alloys or other assorted admixtures; the conductor can also be a non-metallic compound material capable of conductivity.

In the invention herein, the word insulation refers to an appropriate material utilized for electrical cable insulation, including polyethylene, polyvinyl chloride, polypropylene, Teflon, polyvinyl chloride copolymer, crosslinked polyethylene, rubber, and other materials. The insulating materials may also be equipped with a flame retardant agent, anti-fungi agent, etc., or the like agents which improve the durability of the insulation materials.

In the described embodiments of the present invention, the insulation used is polyethylene. However, any acceptable insulating material may be used instead. Around the insulation, shielding (not shown) is usually placed. The shielding typically used in conjunction with the invention is conductive polyvinyl chloride, commonly abbreviated PVC. Another layer of shielding that may be used on top of the PVC is oxygen-free copper, also known as OFC. Of course, one of ordinary skill will appreciate that any suitable shielding material may be substituted for the PVC and the OFC.

Additionally, removing some, if not all, of the individual insulation on the conductors also has a distortion inducing effect, which is beneficial for electric instruments as well. Many different combinations of conductors within the cable of the invention are possible, each combination offering subtle alterations of the distortion characteristics.

Thus, a recipe can be derived to add as much, or as little distortion as one feels necessary according to personal taste. Compared to the existent technology, the invention herein provides a multi-conductor audio cable having an extremely balanced high, medium, and low frequency response for good midrange and furthermore, better definition and distortion inducing capabilities.

Many modifications and variations are possible in light of the above teaching. The foregoing is a description of the preferred embodiments of the invention and has been presented for the purpose of illustration and description. It is not intended to be exhaustive and so limit the invention to the precise form disclosed.

The invention is to be determined in accordance with the following claims:

1. An audio signal cable comprising a signal multiple core conduit and a return multiple core conduit, the diameter of said signal conduit and said return conduit being equal; said signal and said return multiple core conduits each containing at least two types of conductors, wherein said conductors are different in shape, parallel arrayed and surrounded by a common insulation.

2. The audio signal cable of claim 1, wherein at least one conductor is a circular solid wire conductor and at least one conductor is a flat solid wire conductor.

3. The audio signal cable of claim 1, wherein at least one conductor is a circular solid wire conductor and at least one conductor is a tinsel wire conductor.

4. The audio signal cable of claim 1, wherein at least one conductor is a circular solid wire conductor and at least one conductor is a magnet wire conductor.

5. The audio signal cable of claim 1, wherein at least one conductor is a circular solid wire and at least one conductor is a stranded wire conductor.

6. An audio signal cable comprising a signal multiple core conduit and a return multiple core conduit, the diameter of said signal conduit and said return conduit being equal; said signal and said return multiple core conduits each containing at least one stranded wire conductor and at least one tinsel wire conductor, wherein said conductors are different in shape, parallel arrayed and surrounded by a common insulation.

7. The cable of claim 6, further comprising at least one circular solid wire conductor.

8. The cable of claim 7, wherein at least one said circular solid wire conductor is insulated and at least one said solid circular wire conductor is uninsulated.

9. The cable of claim 7, further comprising at least one flat solid wire conductor.

10. An audio signal cable comprising a signal multiple core conduit and a return multiple core conduit, the diameter of said signal conduit and said return conduit being equal; said signal and said return multiple core conduits each containing at least one stranded wire conductor and at least one flat solid wire conductor, wherein said conductors are different in shape, parallel arrayed and surrounded by a common insulation.

11. The cable of claim 10, further comprising at least one tinsel wire conductor.

* * * * *